US006371367B1

(12) United States Patent
Otero

(10) Patent No.: US 6,371,367 B1
(45) Date of Patent: Apr. 16, 2002

(54) MAILBOX INDICATOR

(76) Inventor: Armando Otero, 714 W. Virginia Ave., Tampa, FL (US) 33603

( * ) Notice: Subject to any disclaimer, the term of this patent is extended or adjusted under 35 U.S.C. 154(b) by 0 days.

(21) Appl. No.: 09/898,973

(22) Filed: Jul. 5, 2001

(51) Int. Cl.[7] ..... B65D 91/00
(52) U.S. Cl. ..... 232/35
(58) Field of Search ..... 232/35, 34; D99/29

(56) References Cited

U.S. PATENT DOCUMENTS 1,060,659 A * 5/1913 Ammann ..... 232/35
2,480,469 A * 8/1949 Horn ..... 232/35
3,331,552 A * 7/1967 Shultz ..... 232/35
3,586,235 A * 6/1971 Fishel ..... 232/35
3,589,329 A * 6/1971 Schuh ..... 232/35
3,904,108 A * 9/1975 File ..... 232/35
3,958,752 A * 5/1976 Pieszchala ..... 232/35
4,005,816 A * 2/1977 Malik ..... 232/35
4,073,430 A * 2/1978 Joris ..... 232/35
4,150,780 A * 4/1979 Mapes ..... 232/35
D278,469 S * 4/1985 Ross ..... D99/28
4,720,042 A * 1/1988 Tapy ..... 232/35

* cited by examiner

*Primary Examiner*—Lynne H. Browne
*Assistant Examiner*—William L. Miller

(57) ABSTRACT

A mailbox indicator for signaling a person that he has mail in his mailbox having a signal flag pivotally affixed to a mailbox at one side. A string mechanism works in conjunction with the mail box door and indicating flag to automatically open and raise the indicating flag when the door is opened.

1 Claim, 5 Drawing Sheets

MAILBOX INDICATOR

BACKGROUND

1. Field of the Invention

Generally, this invention is directed towards mailbox accessories. More specifically, this invention relates to a mailbox indicator that signals a person when he or she has mail in their mailbox.

2. Description of the Prior Art

Several mailbox indicators have been described in the prior art search found including U.S. Pat. No. 6,065,671 wherein, "A roadside mailbox mail delivered indicator is formed by a base flatly attachable to the horizontal top of the mailbox adjacent its door closed end opening, including a planar signal panel pivotally connected to one end of an upstanding portion of the base. A latch tip on the end portion of the signal panel opposite its hinged connection with the base, maintains the signal panel in a horizontal forward position by the mailbox door flange overriding the tip to hold the signal panel in a first cocked position. Opening the mailbox door releases the signal panel to a gravity pivoted upright second position for indicating mail delivery by the postman."

In U.S. Pat. No. 5,816,489, "A combination of a mail box and visual indicator is disclosed. The combination includes a mailbox having front and rear ends and an elongated resilient member having first and second ends. The elongated member is mounted at its first end to the rear end of the mailbox and has a tip protector mounted at its second end. When the door to the mailbox is open, the elongated member swings from an engaged to an extended position so as to indicate the door has been opened and the mail has arrived. The tip protector prevents injury to persons in the vicinity of the box while the elongated member is in motion."

In U.S. Pat. No. 5.660,327, "A system added to a mailbox having a hinged door, said system exposing a visible signal when the mailbox door is opened for mail delivery and then closed. A receptacle (10), fixed in an elevated position to the side of the mailbox, or to its enclosure, holds a delivery indicator (14) which is connected to the mailbox door through a flexible connector (18), such as a monofilament plastic line, and then a fastener (22) that is fastened to the door. When the door is opened this action pulls the delivery indicator (14) free of the receptacle (10). When the door is closed the delivery indicator (14) hangs in a visible position below the mailbox."

In U.S. Pat. No. 5,588,588, "A delivery signal device for use on a variety of mailbox types is provided. When the mailbox door is opened, a sliding—pivoting mechanism is engaged which releases an indicating member, thereby signaling that mail has been delivered."

In U.S. Pat. No. 5,560,540, "A mailbox signal device positioned entirely on the interior surface of the cover of a rural mailbox through which a signal opening is provided wherein the signal device includes a spring mounted panel visible through the signal opening in its signal position and maintained is a non-signal position until the mailperson delivers mail to the box thereby providing a convenient way to determine whether or not mail has been delivered to the box."

In U.S. Pat. No. 5,465,902, "A multi-functional mailbox having a mail housing. The mail housing has a recessed flat bottom and an arched top. A mail housing lid is handedly secured to the open first end of the mail housing. The device has a newspaper housing dimensioned to be received within a recessed bottom of the mail housing. A newspaper housing lid is hingedly secured to the newspaper housing. A sliding indicator means is secured within the newspaper housing lid. The sliding indicator means has a first position indicating the presence of mail and a second position indicating the absence of mail."

While some of the prior art may contain some similarities relating to the present invention, none of them teach, suggest or include all of the advantages and unique features of a personal alarm system that attaches to the bra of a female and is activated by either shock or voice recognition.

SUMMARY

The present invention is directed towards a mailbox indicator that will signal a person that he or she has mail in their mailbox. This apparatus prevents the person from walking to an empty mailbox only to find that there is no mail in the mailbox. The apparatus works by placing a second flag which will be raised every time the mailman opens the mailbox door. When the owner comes home from work, he/she sees the second flag in a raised position knowing that the mailman has opened the mailbox door to place something inside. The owner then walks to the mailbox, retrieves the mail, and pushes the mail indicator back toward the downward position.

Accordingly, it is an object of this invention to provide a mail indicating device that will signal a person that he/she has mail in their mailbox.

Another object of this invention to provide a mail indicator having a second indicating flag that pivots up and down to signal a person that he or she has mail.

Other objects and a fuller understanding of the invention will become apparent from reading the following detailed description of a preferred embodiment in conjunction with the accompanying drawings.

BRIEF DESCRIPTION OF THE DRAWINGS

This invention, together with other objects, features, aspects and advantages thereof, will be more clearly understood from the following description, considered in conjunction with the accompanying drawings.

Five sheets of drawings are furnished, sheet one contains FIG. 1, sheet two contains FIG. 2, sheet three contains FIG. 3, sheet four contains FIG. 4, and sheet five contains FIG. 5.

LIST OF ELEMENTS

Figure 1:
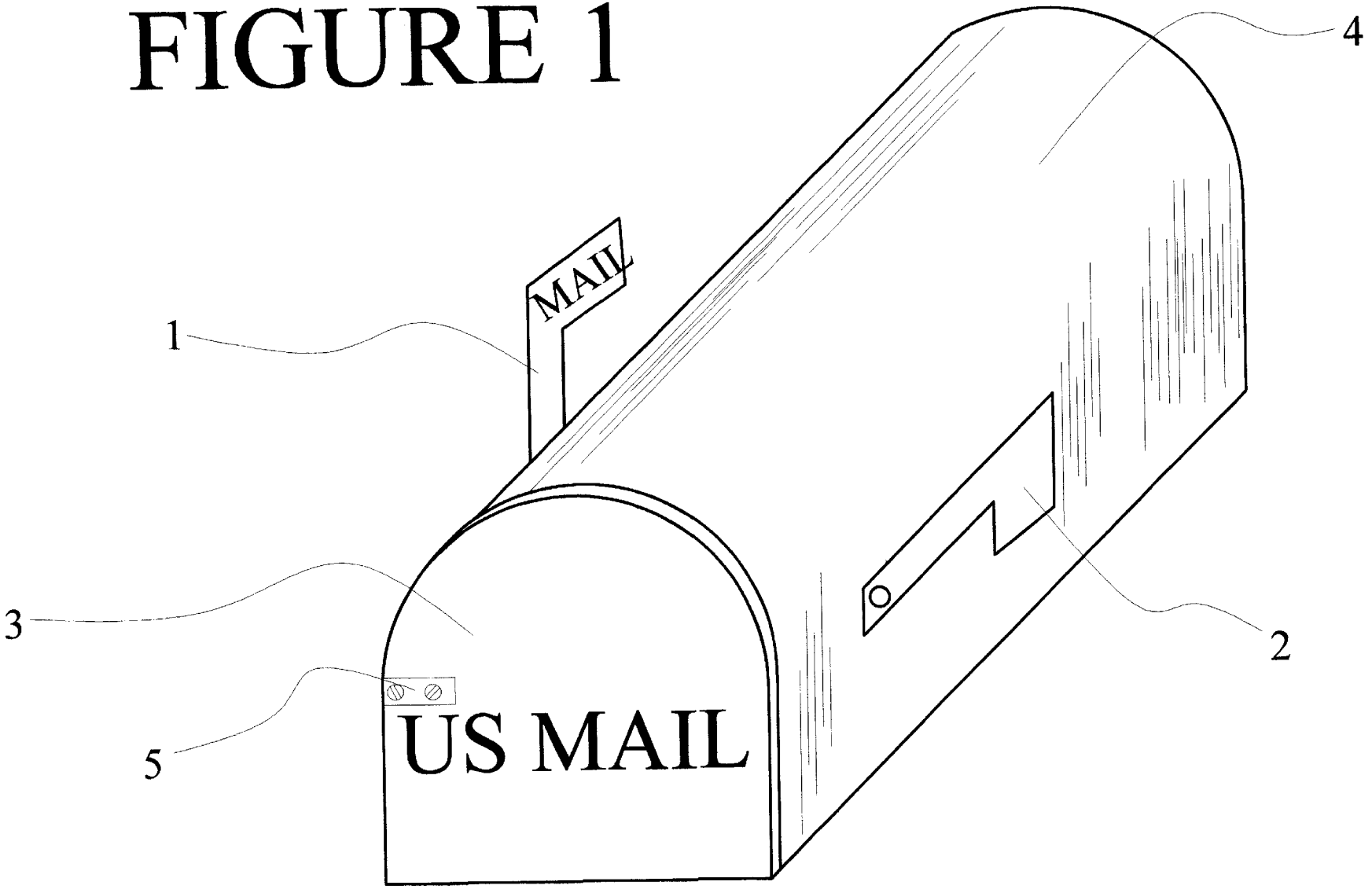
FIG. 1 is a perspective view of a mailbox having a conventional flag to signal the mailman and a second mail indicating flag to signal a user that he or she has mail in their mailbox.

1. Mail indicating flag
2. Mailbox flag
3. Front door
4. Mailbox
5. Front attachment arm
6. string eyelet
7. Mail indicating flag arm
8. String
9. Flag pivot
10. Bottom stop

DESCRIPTION OF THE PREFERRED EMBODIMENTS

Referring now to FIGS. 1–5, starting with FIG. 1, we see a mailbox 4 having a front door 3 and conventional flag 2. At the opposite side of the flag 2, we see a second flag 1 attached to mailbox 4. Furthermore at the front of the mailbox door 3, we see a front attachment arm 5 affixed to the front door 3.

Figure 2:
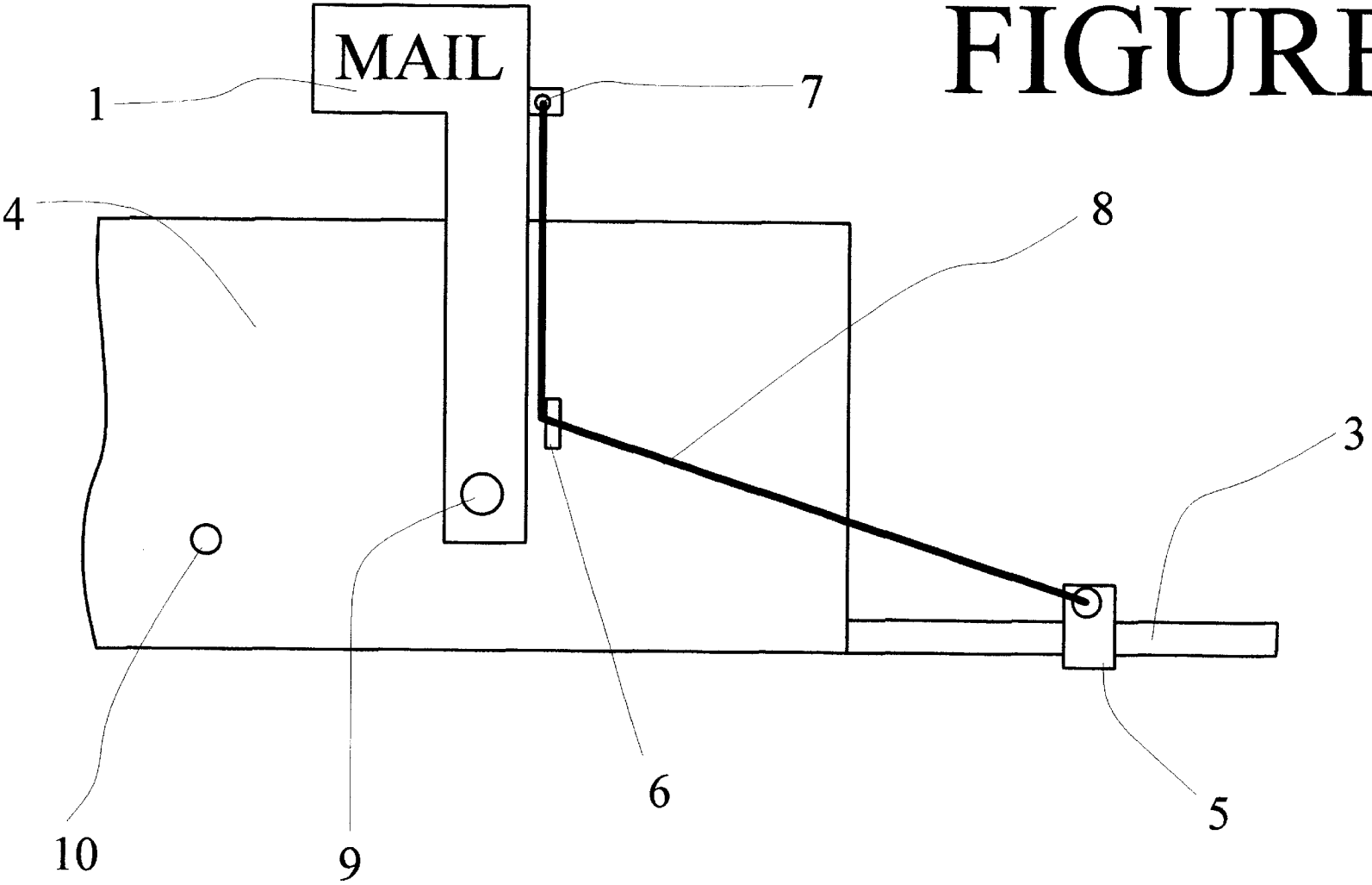
FIG. 2 shows a side view of a mailbox showing the string mechanism attached to the mail indicator and the front door. In this figure, the mail indicating flag is in a full upward position.

FIG. 2 shows a side view of the mailbox 4 having the mail indicating flag 1 in a full upward position signaling a person that there is mail in the mailbox 4. A string 8 is in full extension with the flag 1 in a full upward position and the front door 3 in a full downward position. In this full upward position, the flag 1 is stopped in the full upward position by eyelet 6.

Figure 3:
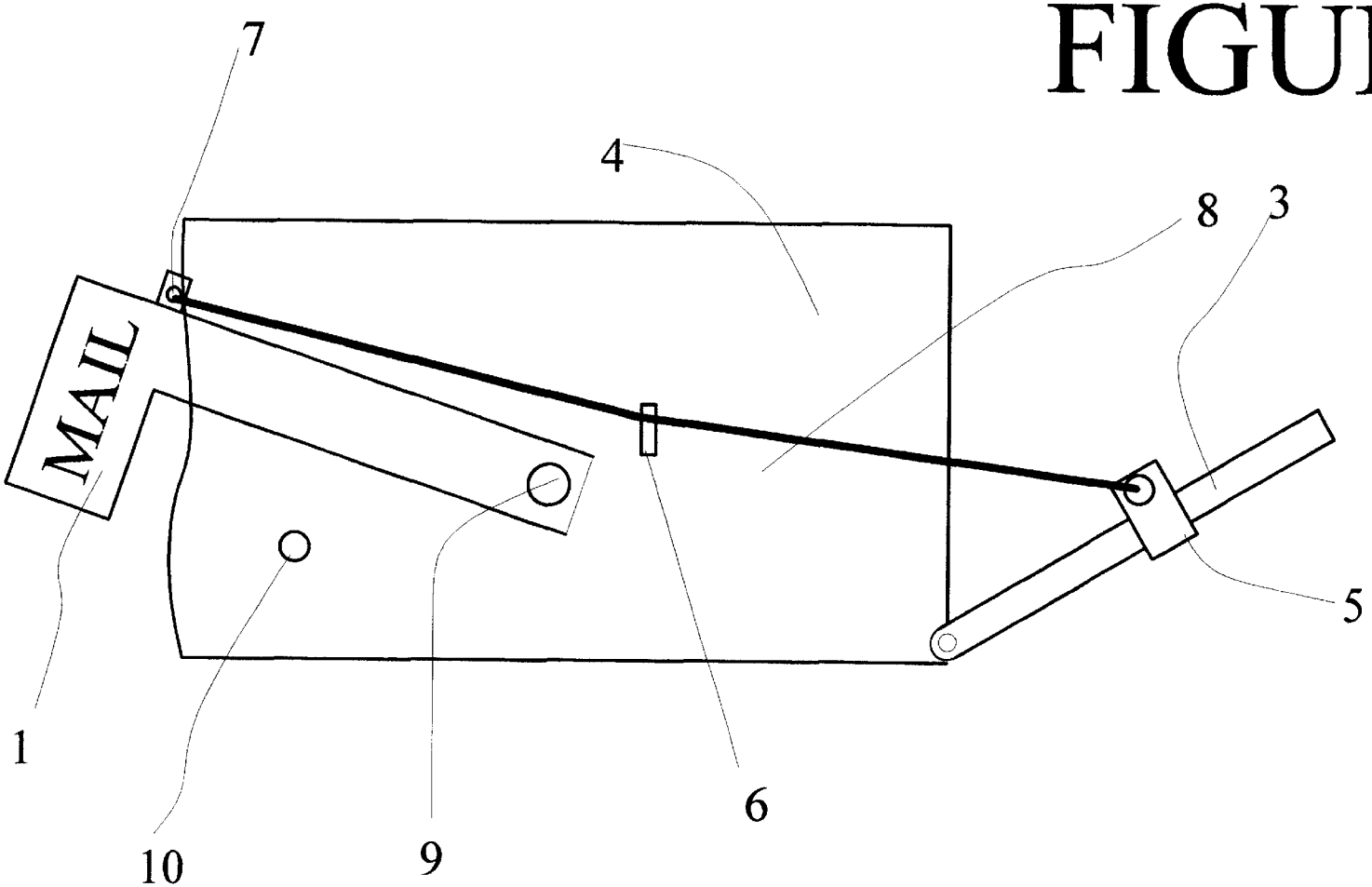
FIG. 3 shows a side view of the mailbox showing the string mechanism attached to the mail indicator at the front door. The mail indicating flag and the front door of the mailbox are in a semi-balanced position with the weight of the front door slightly overcoming the weight of the mailbox flag.

FIG. 3 shows a side view of the mailbox showing the string 8 attached to the mail indicator 1 at the front door 3. The mail indicating flag 1 and the front door 3 of the mailbox 4 are in a semi-balanced position with the weight of the front door 3 slightly overcoming the weight of the mailbox flag. This balancing act between the door 3 and indicator 1 allow the door 3 and indicator 1 to smoothly open and raise automatically respectively without any further assistance. As the mailman opens door 3 past a certain threshold or open position as in FIG. 3, the weight of the door 3 pulls on string 8 which in turn pulls, on indicator 1. note the specific position of attachment arms 7, 5, 6, 9 all work together to allow the indicating flag 1 to open automatically.

Figure 4:
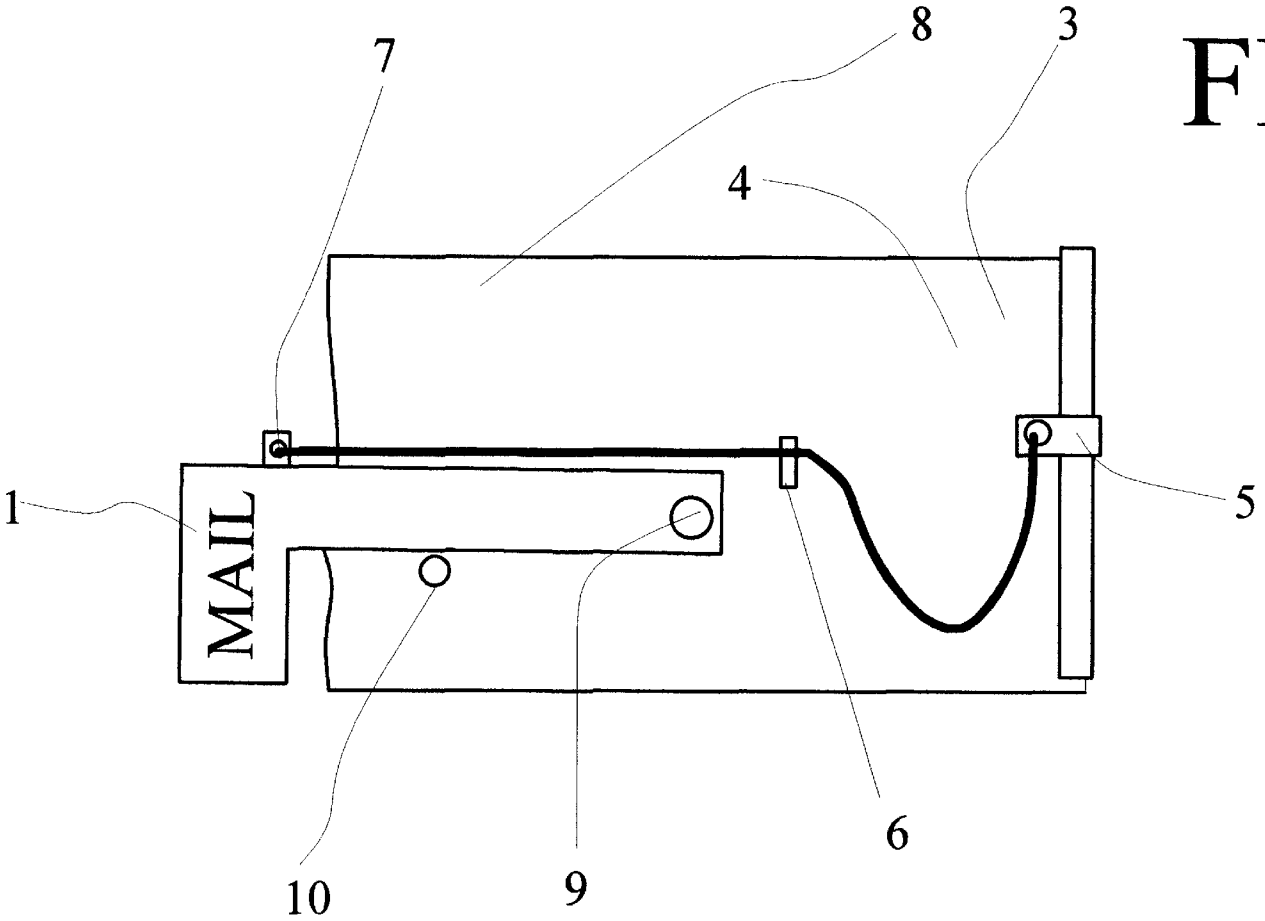
FIG. 4 shows a side view of the mailbox showing the string mechanism attached to the mail indicator at the front door. The mail indicating flag is in a full downward position signaling the owner that there is no mail in the mailbox.

FIG. 4 shows a side view of the mailbox 4 showing the string mechanism 8 attached to the mail indicator 1 at the front door 3. The mail indicating flag 1 is in a full downward position signaling the owner that there is no mail in the mailbox. The flag 1 is stopped from going further downwards by stopping arm 10. This is the position the flag is placed in after the person has retrieved his/her mail.

Figure 5:
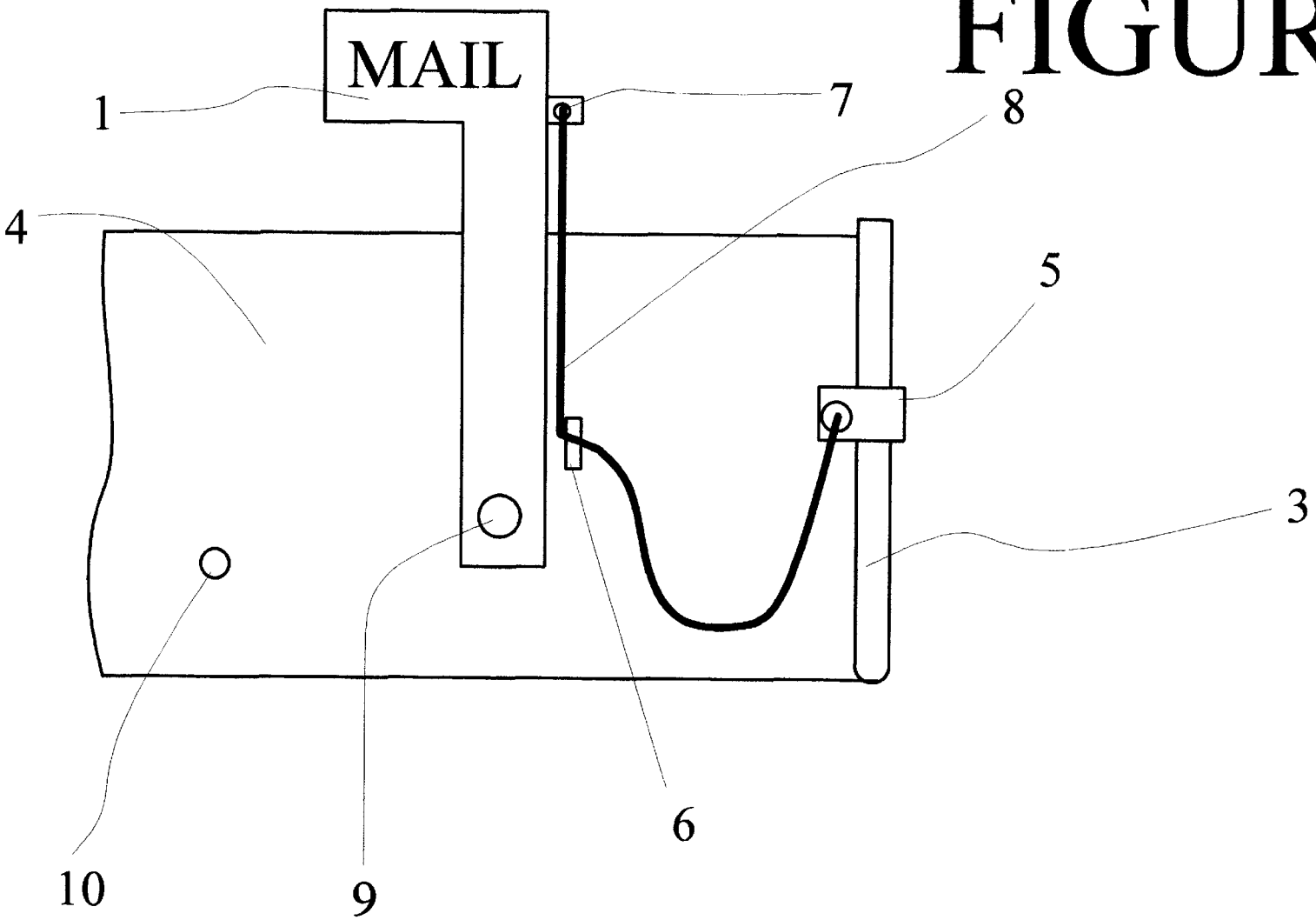
FIG. 5 shows a side view of the mailbox showing the string mechanism attached to the mail indicator at the front door. The mail indicating flag is in a full upward position signaling the owner that there is mail in the mailbox.

FIG. 5 shows a side view of the mailbox 4 showing the string mechanism 8 attached to the mail indicator 1 at the front door 3. The mail indicating flag 1 is in a full upward position signaling the owner that there is mail in the mailbox. This is the position of the flag 1 after the mailman has inserted mail in the mailbox 4 and closed the front door 3.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A mailbox indicator system comprising:

a. a signal flag pivotally affixed to a mailbox at one side thereof, said flag having a first attachment arm, said mailbox having a front door, b. a second attachment arm affixed to said front door, c. an attachment eyelet affixed to said one side of said mailbox, said attachment eyelet providing a top stop for stopping said signal flag when in a full upward position, d. a string affixed to said first attachment arm at one end and attached to said second attachment arm at the other end, said string being strung through said attachment eyelet, e. a bottom stop affixed to said one the side of said mailbox for stopping said signal flag in a full downward position.

* * * * *